US010934806B2

(12) United States Patent
Deolalikar

(10) Patent No.: US 10,934,806 B2
(45) Date of Patent: Mar. 2, 2021

(54) ACTUATION SYSTEM CONTROLLED USING ROTATIONAL SPEED

(71) Applicant: HALLIBURTON ENERGY SERVICES, INC., Houston, TX (US)

(72) Inventor: Neelesh Deolalikar, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 74 days.

(21) Appl. No.: 16/308,126

(22) PCT Filed: Sep. 28, 2016

(86) PCT No.: PCT/US2016/054116
§ 371 (c)(1),
(2) Date: Dec. 7, 2018

(87) PCT Pub. No.: WO2018/063181
PCT Pub. Date: Apr. 5, 2018

(65) Prior Publication Data

US 2019/0178055 A1 Jun. 13, 2019

(51) Int. Cl.

| | |
|---|---|
| ***E21B 34/12*** | (2006.01) |
| ***E21B 7/28*** | (2006.01) |
| ***E21B 21/10*** | (2006.01) |
| ***E21B 10/32*** | (2006.01) |
| ***E21B 41/00*** | (2006.01) |

(52) U.S. Cl.
CPC ..... *E21B 34/12* (2013.01); *E21B 7/28* (2013.01); *E21B 10/322* (2013.01); *E21B 10/325* (2013.01); *E21B 21/103* (2013.01); *E21B 41/00* (2013.01); *E21B 2200/04* (2020.05)

(58) Field of Classification Search
CPC ..... E21B 34/12
See application file for complete search history.

(56) References Cited

U.S. PATENT DOCUMENTS 2,572,299 A * 10/1951 Antolch ..... E21B 21/10 137/527
2,750,154 A * 6/1956 Boice ..... E21B 4/10 173/205

(Continued)

FOREIGN PATENT DOCUMENTS

WO 2015085148 A1 6/2015

OTHER PUBLICATIONS

International Search Report and Written Opinion dated Jun. 16, 2017 for international patent application No. PCT/US2016/054116, filed on Sep. 28, 2016.

*Primary Examiner* — Kipp C Wallace
(74) *Attorney, Agent, or Firm* — Chamberlain Hrdlicka

(57) ABSTRACT

An actuation system to control flow of a fluid includes a body including an axial cavity and a valve in fluid communication with the axial cavity, the valve including a closing member moveable into and out of a closed position against the valve seat, and a resistance member. Fluid from the axial cavity can flow through and out of the valve when the closing member is out of the closed position and the closing member is biased into or out of the closed position by a force applied by the resistance member. The closing member is movable out of or into the closed position upon a rotational speed and fluid pressure within the axial cavity being sufficient to overcome the force applied by the resistance member.

18 Claims, 7 Drawing Sheets

(56) References Cited

U.S. PATENT DOCUMENTS

| | | | | |
|---|---|---|---|---|
| 2,879,032 | A * | 3/1959 | Whittle | E21B 4/02 175/25 |
| 3,303,893 | A * | 2/1967 | Varney | E21B 44/005 175/26 |
| 3,504,750 | A * | 4/1970 | Rouviere | E21B 25/00 175/244 |
| 3,967,680 | A * | 7/1976 | Jeter | E21B 4/00 175/38 |
| 4,721,172 | A * | 1/1988 | Brett | E21B 4/02 175/107 |
| 5,398,713 | A | 3/1995 | Whitman | |
| 2005/0211471 | A1* | 9/2005 | Zupanick | E21B 21/103 175/57 |
| 2007/0012454 | A1 | 1/2007 | Ross et al. | |
| 2009/0065218 | A1 | 3/2009 | Loretz et al. | |
| 2012/0199366 | A1 | 8/2012 | Gaskin et al. | |
| 2013/0240212 | A1 | 9/2013 | Basmajian et al. | |

* cited by examiner

ACTUATION SYSTEM CONTROLLED USING ROTATIONAL SPEED

BACKGROUND

Electrical generators are often used to generate and to supply power, for example, to a downhole environment. In some production environments, however, it can be difficult or impractical to provide electrical power and signals using a generator. For example, the location of the generator can obstruct an area of the wellbore to be occupied by a drillstring or other downhole equipment, as well as, inhibit fluid flow through the wellbore. Batteries, in some cases, may be used to supply electrical power to equipment and instrumentation in a downhole environment. However, batteries can include temperature limitations and may store a limited amount of power, thus, requiring frequent replacement, recharging, or both. Furthermore, drilling and production operations often take place in remote locations where access to and the ability to provide electrical power sources, electrical power grids, and/or equipment used to generate electrical energy is limited.

BRIEF DESCRIPTION OF THE DRAWINGS

For a detailed description of the embodiments of the invention, reference will now be made to the accompanying drawings in which.

DETAILED DESCRIPTION

The actuation system of the embodiments is implemented and powered by sources other than electrical energy to control the flow and delivery of wellbore fluids. Accordingly, this disclosure describes using rotational energy to actuate an actuatable device, for instance, a control valve. In particular, the rotational speed of a rotating body maintains or overcomes a biasing mechanism of the actuatable device to control a fluid flow therein. In the present examples, adjusting the rotational speed of the rotating body alleviates the use of additional equipment to actuate the actuatable device and to enable efficiency during overall oil and gas operations.

Figure 1:
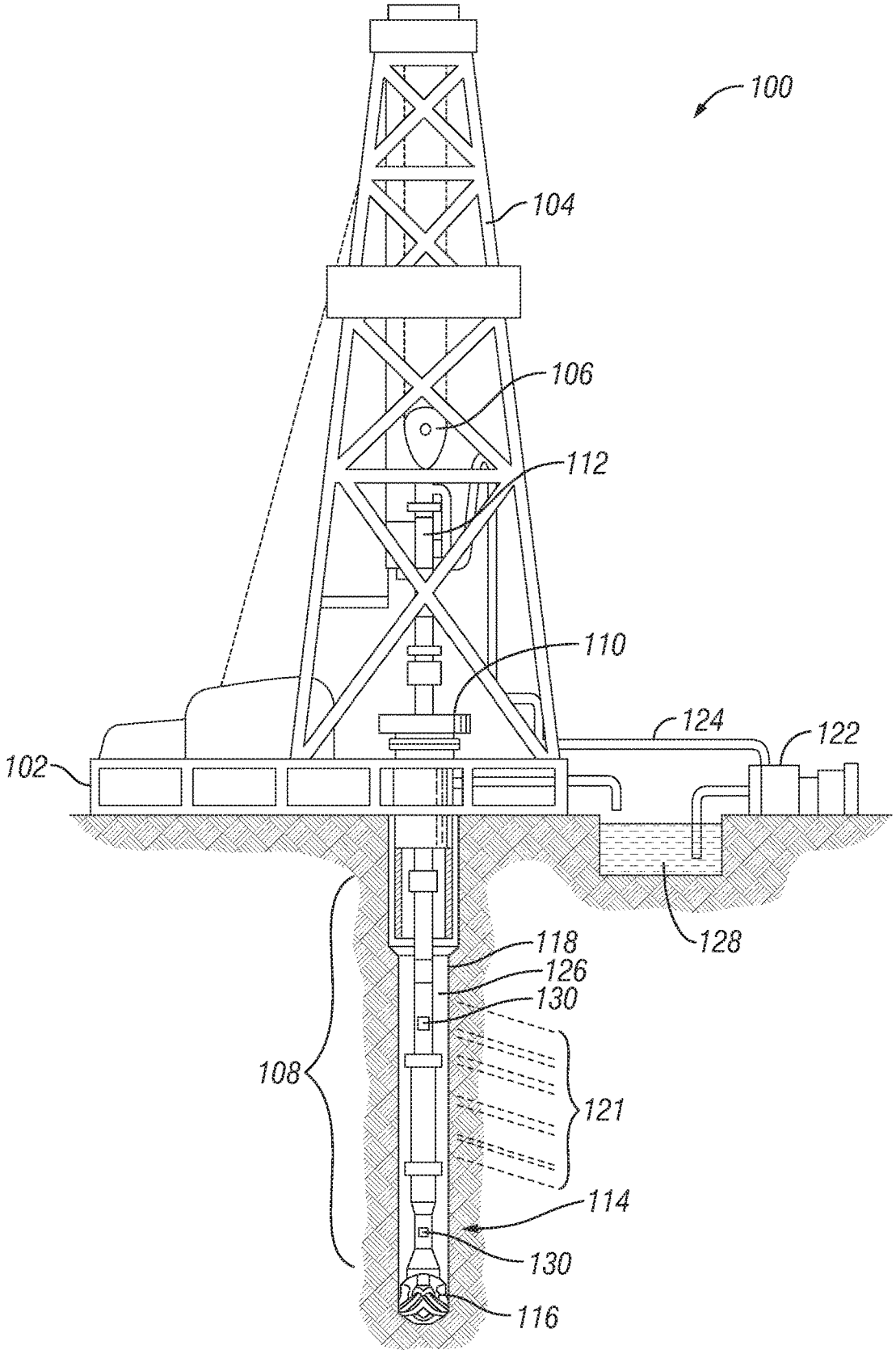
FIG. 1 is a schematic view of an oilfield environment, according to one or more embodiments.

FIG. 1 is a schematic view of an oilfield environment 100, according to one or more embodiments. While FIG. 1 depicts an onshore oilfield environment 100, it would be understood that drilling and production operations can occur in an offshore environment as well. Additionally, other equipment not described with respect to FIG. 1 can also be used in the oilfield environment 100.

A drilling platform 102 is equipped with a derrick 104 that supports a hoist 106. The hoist 106 raises and lowers a pipe string, such as a drill string 108, through a wellhead 110. The hoist 106 suspends a top drive 112 that rotates the drill string 108, which includes a bottom-hole assembly (BHA) 114 connected to the lower end of the drill string 108. The BHA 114 provides directional control, for example, to control the trajectory of a drill bit 116, and consequently, the trajectory of a wellbore 118. The BHA 114 can include various downhole devices including the drill bit 116, drill collars, subs such as stabilizers, reamers, shocks, hole-openers, and bit subs. In operation, the drill bit 116 rotates through various formations 121 to form the wellbore 118. The BHA 114 can also include a mud motor, directional drilling and measuring equipment, logging-while-drilling tools, and other devices used in drilling the wellbore 118. Although FIG. 1 depicts the wellbore 118 as a vertical wellbore, it should be understood that the wellbore 118 may be vertical, inclined, horizontal, or of other trajectories.

A pump 122 pumps a drilling fluid down the drill string 108 through the BHA 114 and the drill bit 116. The pump 122 circulates the drilling fluid through a supply pipe 124, through the interior of drill string 108 and the BHA 114, and through orifices in the drill bit 116. The drilling fluid exits the drill bit 116 to flow upward into an annulus area 126 located between the drill string 108 and the wellbore 118. The drilling fluid flows into a retention pit 128 for further circulation via the pump 122. The drilling fluid, also referred to as drilling mud, is added to the wellbore 118 to facilitate the drilling process and to maintain the integrity of the wellbore 118.

The drill string 108 and other areas of the drill string 108, such as the BHA 114, may include one or more valves 130 to regulate the passages of the drilling fluid, or other types of fluids, for example, treatment fluids. In the embodiments, the valve 130 controls the flow of the drilling fluid as it flows into the drill string 108 or in the annulus area 126 during drilling operations or other operations including, fracturing and production operations. In the embodiments, rotational energy is used to actuate the control valve 130, or any other actuatable devices of the oilfield environment 100, to control a fluid flow therein.

It is to be recognized that the oilfield environment 100 of FIG. 1 is merely exemplary in nature and that various additional components may be present that have not necessarily been illustrated in the interest of clarity. For example, additional components that may be present include, but are not limited to, adapters, joints, gauges, sensors, compressors, pressure controllers, pressure sensors, flow rate controllers, flow rate sensors, temperature sensors, and the like.

Figure 2A:
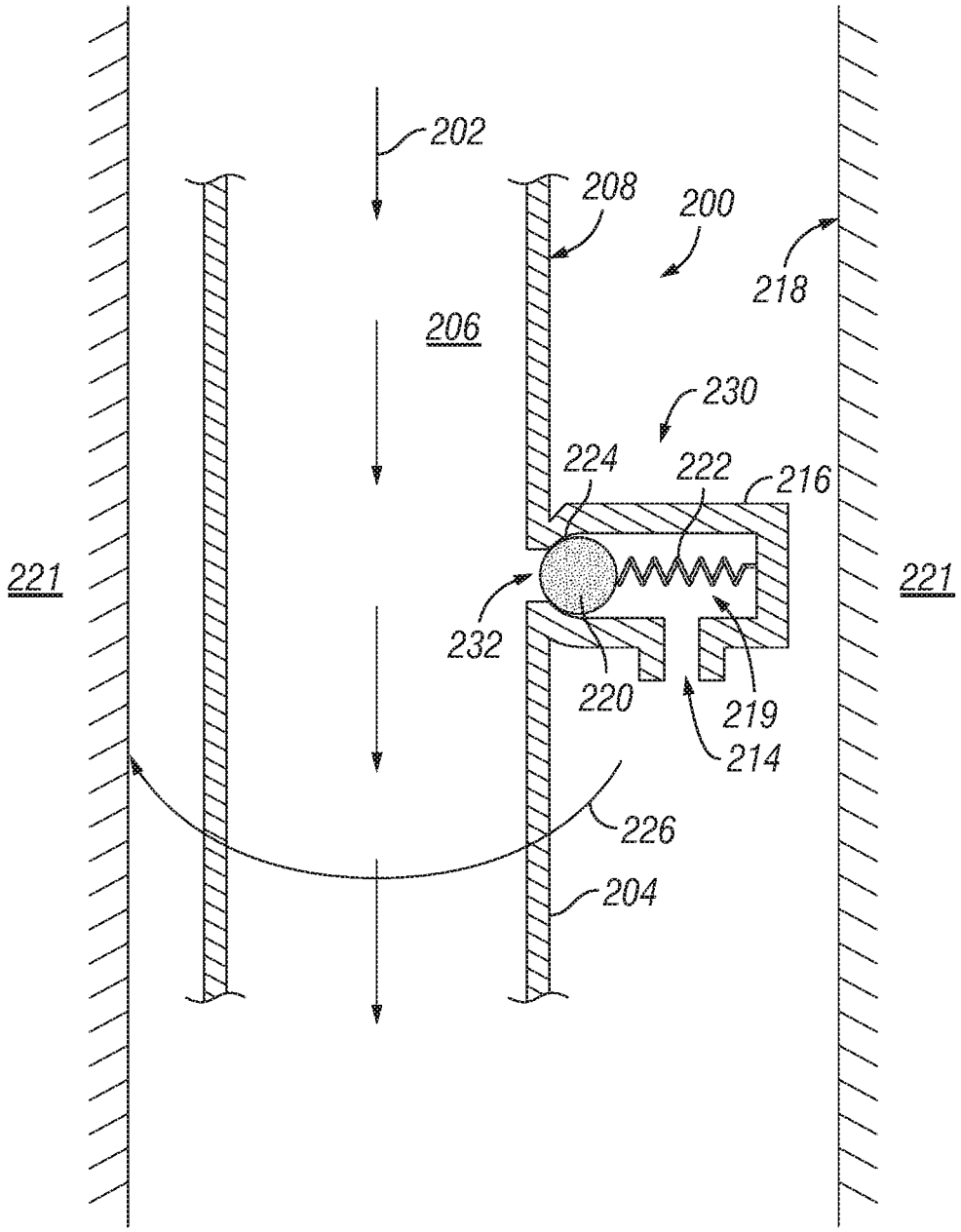
FIG. 2A is a cross-sectional view of a tubular string, including an actuation system, according to one or more embodiments.

FIG. 2A is a cross-sectional view of an actuation system 200 including a tubular string, such as a drill string 208, for actuating a valve 230. Although explained in reference with a drill string, it should be appreciated that the actuation system 200 may involve any suitable rotatable object. Connected with the drill string 208 is an actuating device, i.e., the valve 230, configured to control a fluid flow through the valve 230. As shown, the drill string 208 extends through a wellbore 218 of a formation 221 and includes a longitudinally-extending body 204 that includes an internal central bore 206 for flowing a fluid 202, for example, a drilling fluid or a treatment fluid. The function of the fluid 202 includes, but is not limited to, suspending drill cuttings, controlling pressure, stabilizing exposed rock, providing buoyancy, and cooling and lubricating downhole equipment. The fluid 202 can include a high-pressure fluid including a water-based fluid, a brine-based fluid, an oil-based fluid, or a synthetic based fluid in any combination.

As shown in FIG. 2A, the valve 230 is mounted to an external surface of the body 204 of the drill string 208 and in fluid communication with the central bore 206 through an inlet 232. For example, the valve 230 can be directly mounted by screwing into a threaded connector of the body 204 or physically attached to the outer surface of the body 204, for example, using welding techniques. Although shown mounted in a section of drill pipe in the drill string 208, the valve 230 may be mounted in other areas of the drill string 208, such as within a BHA, or as a component part of a downhole tool, for example, a reamer.

The valve 230 is a check valve and in the example shown is a ball check valve to control the flow of the fluid 202 through the body 204. It should be appreciated though that other types of check valves may be used. The type of valve used varies based on various factors, such as, the characteristics of the fluid 202 and the environment of the wellbore 218.

The valve 230 includes a valve housing 216 with an internal cavity 219 and an outlet 214 for the fluid 202. As illustrated, the valve housing 216 also includes a movable closing member 220, e.g., a ball, and a resistance member 222, e.g., a spring. In other examples, the closing member 220 can include a plate, a popper, a disc, or other types of isolation elements or closing members. The closing member 220 is configured to move radially relative to the central bore 206 and to control flow of the fluid 202 through the valve 230. The closing member 220 is biased by the resistance member 222 into a closed position to prevent the flow of the fluid 202 through the valve 230. In particular, the resistance member 222 forces the closing member 220 upon a valve seat 224 to close the valve 230 and to prevent the flow of the fluid 202 through the cavity 219. The valve 230 can actuate between a fully closed position to prevent fluid flow through the valve 230, as shown in FIG. 2A, or a fully open position to permit fluid flow through the valve 230, as will be described with respect to FIG. 2B.

Actuating the valve 230 includes two factors, fluid pressure and rotational speed. A minimum fluid pressure is often required to actuate the valve 230, and depending on the size and type of valve 230, the pressure may range, for example, between 1 psi and 5 psi. In most drilling operations, a fluid pressure differential is created as the fluid 202 flows within the drill string 208 and thus, provides a source for the minimum pressure flow. In the closed position shown in FIG. 2A, the force of the resistance member 222 is greater than the force from the pressure of the fluid 202 flowing through the drill string 208. However, fluctuations in the fluid pressure through the body 204 can affect the valve 230 and move the closing member 220 away from the closed position as explained further below.

Regarding the second factor, rotational speed, an adjustment to the rotational speed of the body 204 can change the centrifugal force exerted on the closing member 220 to move the closing member 220 away from the closed position. The rotational speed, or the rotations per minute (RPM), of the body 204 determines the centrifugal force generated and exerted on the closing member 220. As depicted by arrow 226, the body 204 rotates at a rotational speed to exert a centrifugal force. Without considering internal fluid pressure, if the centrifugal force exerted is less than the biasing force exerted by the resistance member 222, then the position of the closing member 220 is maintained, e.g., closed position, against the valve seat 224. Accordingly, the closing member 220 maintains the closed position of FIG. 2A to prevent the flow of fluid 202 into the cavity 219.

Figure 2B:
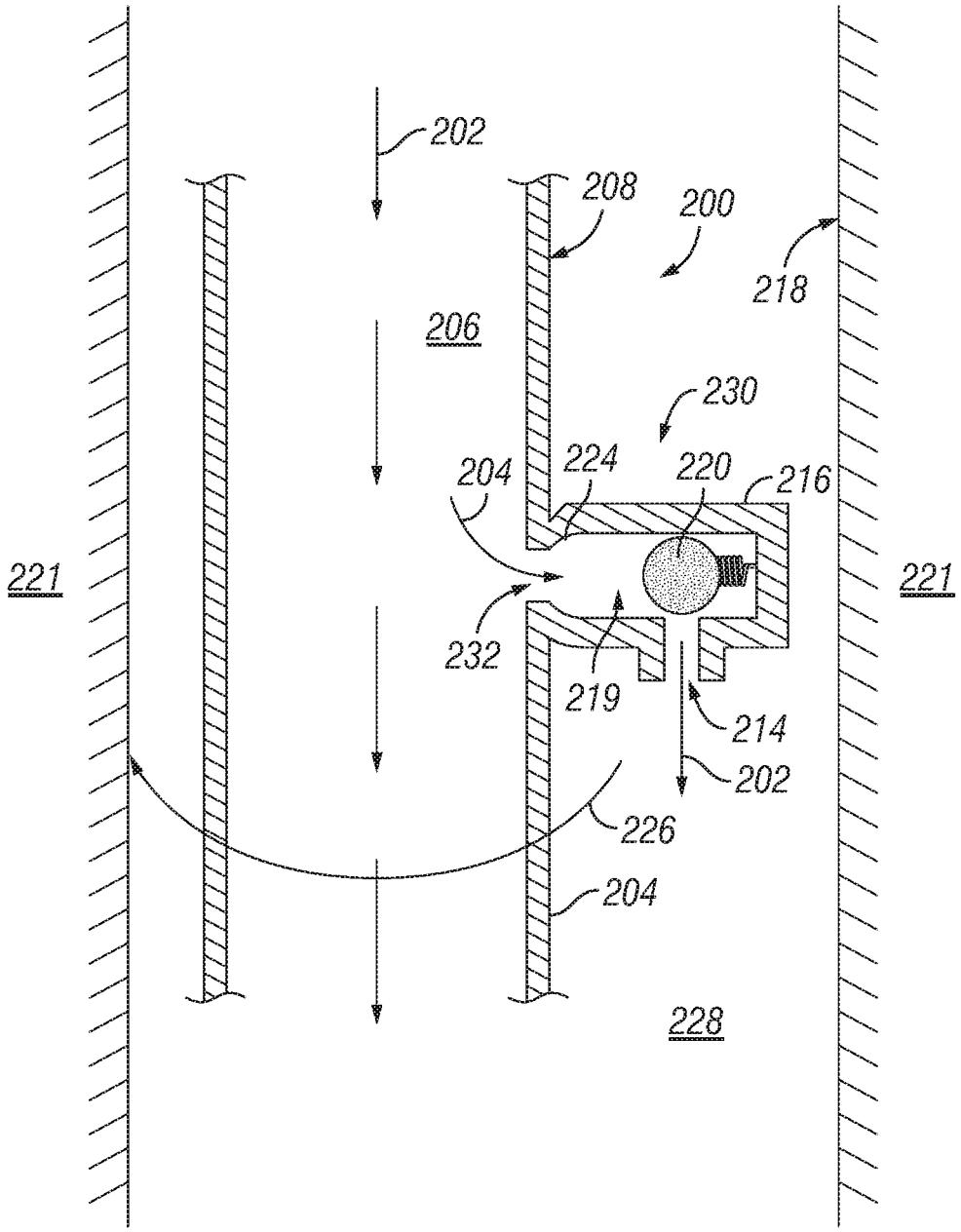
FIG. 2B is a cross-sectional view of a tubular string, including the actuation system of FIG. 2A, according to one or more embodiments.

FIG. 2B is a cross-sectional view of the actuation system 200 including the drill string 208 and the valve 230 wherein the valve 230 has been actuated to be open and permit fluid flow through the actuation system 200. In some cases, an open configuration of the valve 230 can relieve flow pressure in the drill string 208 and/or regulate fluid flow between the central bore 206 and the cavity 219 of the valve 230. When the valve 230 is opened, the fluid can be diverted from the body 204 to other areas external to the central bore 206, for example, an annulus area 228.

As depicted by arrow 226, the body 204 rotates at an increased rotational speed that, when combined with or without the internal fluid pressure, is sufficient to overcome a minimum threshold of the force exerted by the resistance member 222. The centrifugal force exerted on the closing member 220 due to the increased rotational speed forces the closing member 220 into an open position away from the valve seat 224 and out of the closed position. As the closing member 220 moves radially outward, the fluid 202 may flow through the inlet 232 and into the cavity 219. The fluid 202 flows through the cavity 219 and out of the valve 230 through an outlet 214. Accordingly, an increase in the rotational speed of the body 204 can adjust the centrifugal force exerted on the closing member 220 to move the closing member 220 into an open position, thus, placing the valve 230 into an open configuration.

The centrifugal force exerted on the closing member 220 can be expressed as $F=m \cdot r \cdot w2$, where F is the centrifugal force, m is the mass of the closing member 220, r is the distance of the resistance member 222 from the rotational axis of the drill string 208, and w is the rotational speed of the drill string 208.

As shown in FIG. 2A, as the rotational speed of the drill string 208 decreases or is maintained below a specified range of speed, the centrifugal force exerted decreases or is maintained to close the valve 230 until it reaches a fully closed position. Conversely, as shown in FIG. 2B, as the rotational speed of the drill string 208 increases, the centrifugal force exerted can increase to open the valve 230 until it reaches a fully open position Accordingly, the valve 230 can be configured to open or close when the rotational speed, i.e., the RPM, of the body 204 increases above a specified range of speed or decreases below a specified range of speed, respectively. In other examples, the valve 230 may be actuated to a partially open position or a partially closed position using the rotational speed of the body 204 as well.

While specific configurations of the valve 230 are shown and described in FIGS. 2A and 2B, it should be understood that other configurations of the valve 230 may be used in conjunction with embodiments of the present disclosure.

Figure 3A:
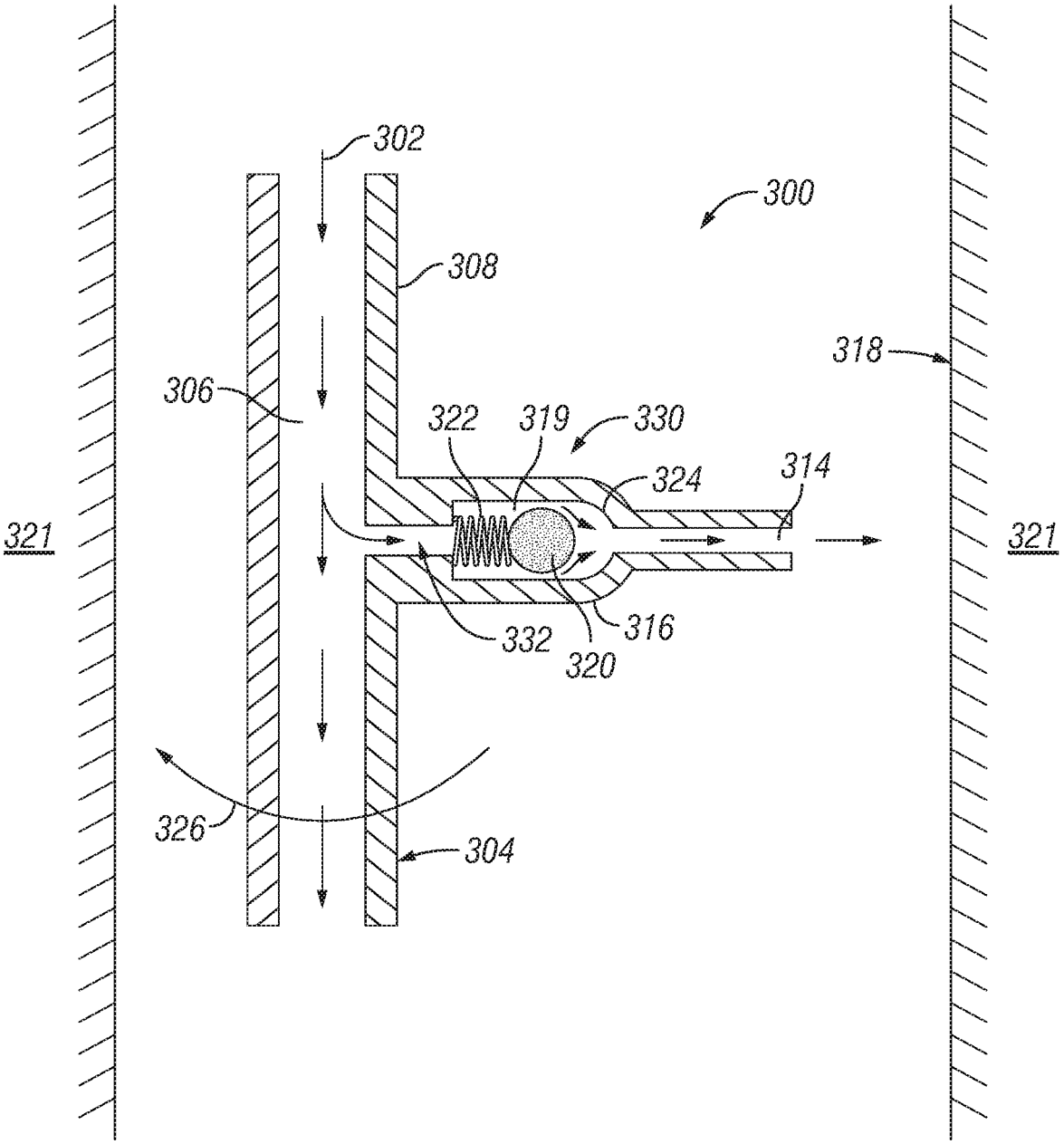
FIG. 3A is a cross-sectional view of a tubular string, including an actuation system according to one or more embodiments.

FIG. 3A is a cross-sectional view of a drill string 308, including an actuation system 300 configured to permit a fluid flow into the actuation system 300 when a rotational speed of the drill string 308 is decreased. A valve 330 is mounted to an external surface of a longitudinally-extending body 304 of the drill string 308 and in fluid communication with a central bore 306 through an inlet 332 of the valve 330. As shown, the drill string 308 extends through a wellbore 318 of a formation 321 where a fluid 302 flows through the central bore 306, for example, a drilling fluid or a treatment fluid. The type of valve used varies based on various factors, such as, the characteristics of the fluid 302 and the environment of the wellbore 318. For example, the valve 330 may include a one-way ball valve to control the flow of the fluid 302 through the body 304.

A movable closing member 320, e.g., a ball, and a resistance member 322, e.g., a spring, are configured within a valve housing 316 of the valve 330. The closing member 320 is attached to the resistance member 322 that rests in a compressed state, as shown in FIG. 3A. The closing member 320 is movable within a cavity 319 of the valve 330 based on a biasing force exerted on the resistance member 322. In particular, the closing member 320 is configured to move radially relative to the central bore 306 and to control the flow of the fluid 302 through the valve 330. The closing member 320 can include a ball, a plate, a popper, a disc, or other types of isolation elements or closing members.

The body 304 of the valve 330 can be rotated at a decreased speed or at a speed maintained below a specified rotational speed in order to adjust the centrifugal force exerted on the closing member 320. In particular, when the rotational speed decreases, the centrifugal force generated by the rotational motion may be less than the force exerted by the resistance member 322. In this regard, the resistance member 322 maintains a compressed position to bias the closing member 320 to an open position. In the open position, the closing member 320 is disposed away from the valve seat 324 so that the fluid 302 can flow from the bore 306 into the cavity 319 to exit an outlet 314 of the valve 330.

Figure 3B:
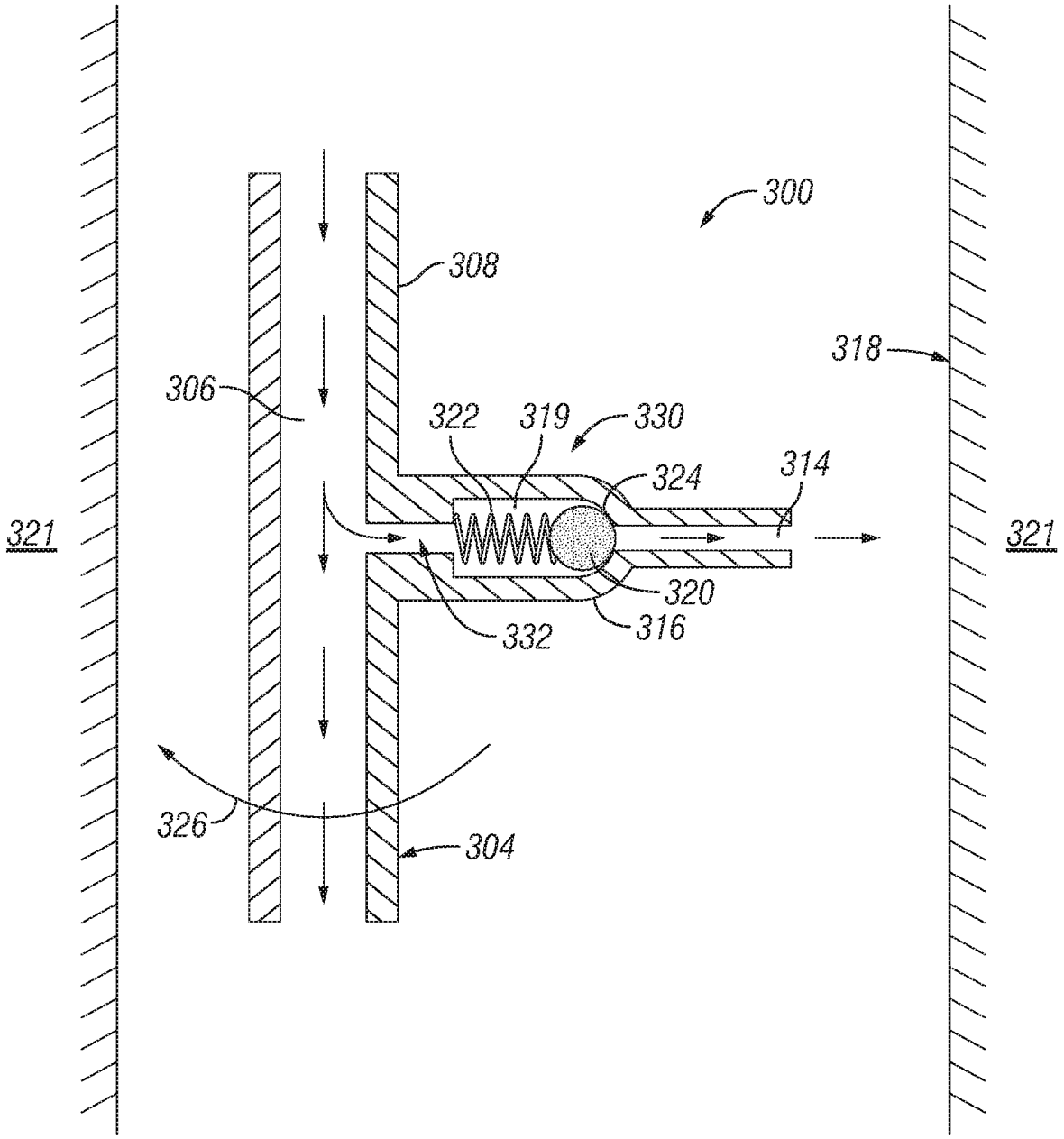
FIG. 3B is a cross-sectional view of a tubular string, including the actuation system of FIG. 3A, according to one or more embodiments.

FIG. 3B is a cross-sectional view of the drill string 308 and the actuation system 300 in a closed position configured to prevent a fluid flow through the actuation system 300 when a rotational speed of the drill string 308 is increased. As depicted by arrow 326, the body can 304 rotate at a rotational speed maintained above a specified speed or the rotational speed of the body 304 can be increased. Without considering internal fluid pressure or other factors, the maintained or increased rotational speed of the body 304 generates a centrifugal force greater than a biasing force of the resistance member 322 to force the closing member 320 into a closed position. Specifically, the centrifugal force exerts a force to move the resistance member 322 from a compressed position to an extended position, as shown in FIG. 3B. The extension of the resistance member 322 forces, or biases, the closing member 322 against the valve seat 324 in order to prevent the flow of the fluid 302 from the cavity 319 via the outlet 314.

As shown in FIG. 3A, as the rotational speed of the drill string 308 decreases or is maintained below a specified rotational speed, the centrifugal force exerted decreases and does not overcome the biasing of the resistance member 322. Thus, the resistance member 322 does not exert a force on the closing member 320, which maintains a position located away from the valve seat 324. Conversely, as shown in FIG. 3B, as the rotational speed of the drill string 308 increases, the centrifugal force exerted on the resistance member 322 increases to close the valve 330, i.e., move the closing member 320 towards the valve seat 324, until it reaches a fully closed position Accordingly, the valve 330 can be configured to open or close when the rotational speed of the body 304 decreases below a specified rotational speed or increases above a specified rotational speed, respectively.

While the valves 230, 330 of FIGS. 2A, 2B, 3A, and 3B are shown and described with respect to certain configurations, it is understood that equivalent alterations and modifications will occur upon the reading and understanding of the specification. For instance, the valves 230, 330 can be component parts of a downhole tool, such as a reamer, that is retracted by closing the valves 230, 330 or expanded by opening the valves 230,330 using a combination of rotational speed and an internal fluid pressure. Thus, the downhole tool can be actuated while continuing to operate the drill string 208 at a specified RPM, i.e., rotational speed.

Figure 4A:
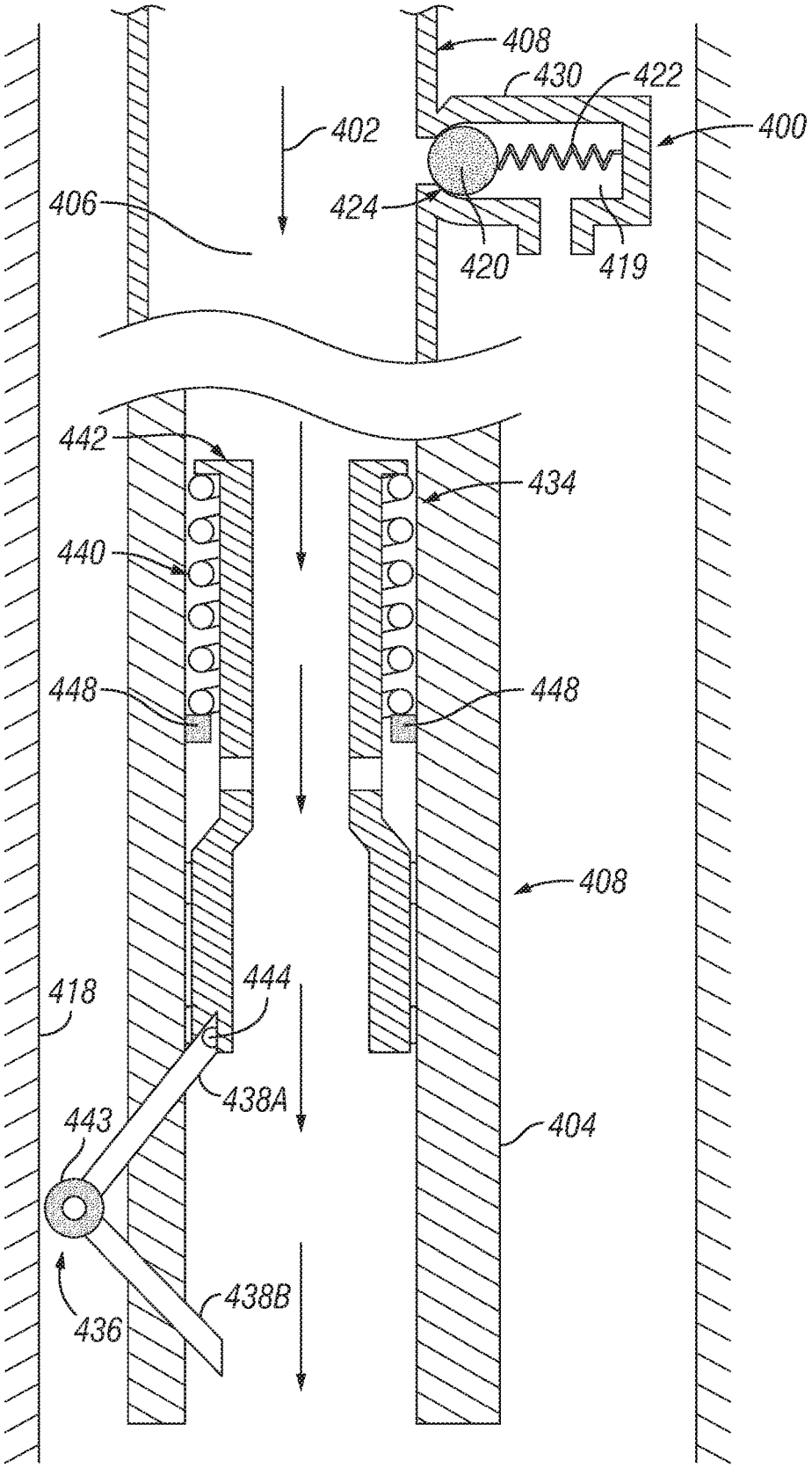
FIG. 4A is a cross-sectional view of an expandable downhole reamer used with an actuation system, according to one or more embodiments.

FIG. 4A is a cross-sectional view of an expandable downhole reamer 434 used with an actuation system 400 and configured to move the reamer 434 to an expanded position 436. The reamer 434 is often used in downhole operations, such as drilling operations, to create holes through a formation, smooth a wellbore, enlarge holes in a well to a specified size, stabilize a bit, and/or drill directionally in the well, or the like. The reamer 434 can be connected in a tubular string, such as a drill string 408, or to a drill pipe of the drill string 408. The reamer 434 includes reamer arms 438A, 438B, a biasing member 440, a piston 442, and pivot points 443, 444 directly coupled to the reamer 434, as shown in FIG. 4A, or indirectly coupled to the reamer 434. One of the reamer arms 438B is axially affixed and connected to the piston 442 via the pivot point 444. The pivot points 443, 444 provide pivoting axes about which rotation can occur to expand or retract the reamer arms 438A, 438B based on the movement of the piston 442, or other actuation mechanisms.

Fluid pressure or ball drop mechanisms, among other pressure-based systems, can actuate the reamer 434 to a retracted configuration or expanded configuration. For instance, a fluid 402 flowing through the drill string 408 or a pressure drop across a drill bit may exert a pressure force against the piston 442. The pressure acts on and pushes the piston 442 against a resistance component, such as the biasing member 440, to linearly move the piston 442. The linear motion of the piston 442 is converted by the pivot points 443, 444 into radial motion to move the reamer 434 into the extended position 436, as shown in FIG. 4A, or a retracted position, as will be further described.

In the examples, the pressure exerted by the fluid flow can be influenced by the rotational speed of the drill string 408. In particular, the actuation of a valve 430 connected with the drill string 408 can control the fluid flow through the drill string 408. The rotational speed, or the rotations per minute (RPM), of a body 404 of the drill string 408 determines the centrifugal force generated and exerted on a closing member 420 housed within a cavity 419 of the valve 430.

When the centrifugal force exerted is minimal or less than the biasing force exerted by a resistance member 422 of the valve 430, the closing member 420 is maintained in a closed position, as shown in FIG. 4A, to prevent fluid flow through the valve 430. The fluid 402 flows through the drill string 408 without diverting into the valve 430. The fluid 402 continues through a central bore 406 of the drill string 408 to exert a pressure force capable of moving the piston 442 until the biasing member 440 reaches a hard stop 448 and further upon compression of the biasing member 440. The linear motion of the piston 442 is converted by the pivot points 443, 444 into radial motion to move the reamer 438 into the extended position 436. The reamer 438 extends away from the body 404 to contact a surface of a wellbore 418, for example, to create holes, smooth surfaces, and enlarge holes to a specified size in the wellbore 418.

Figure 4B:
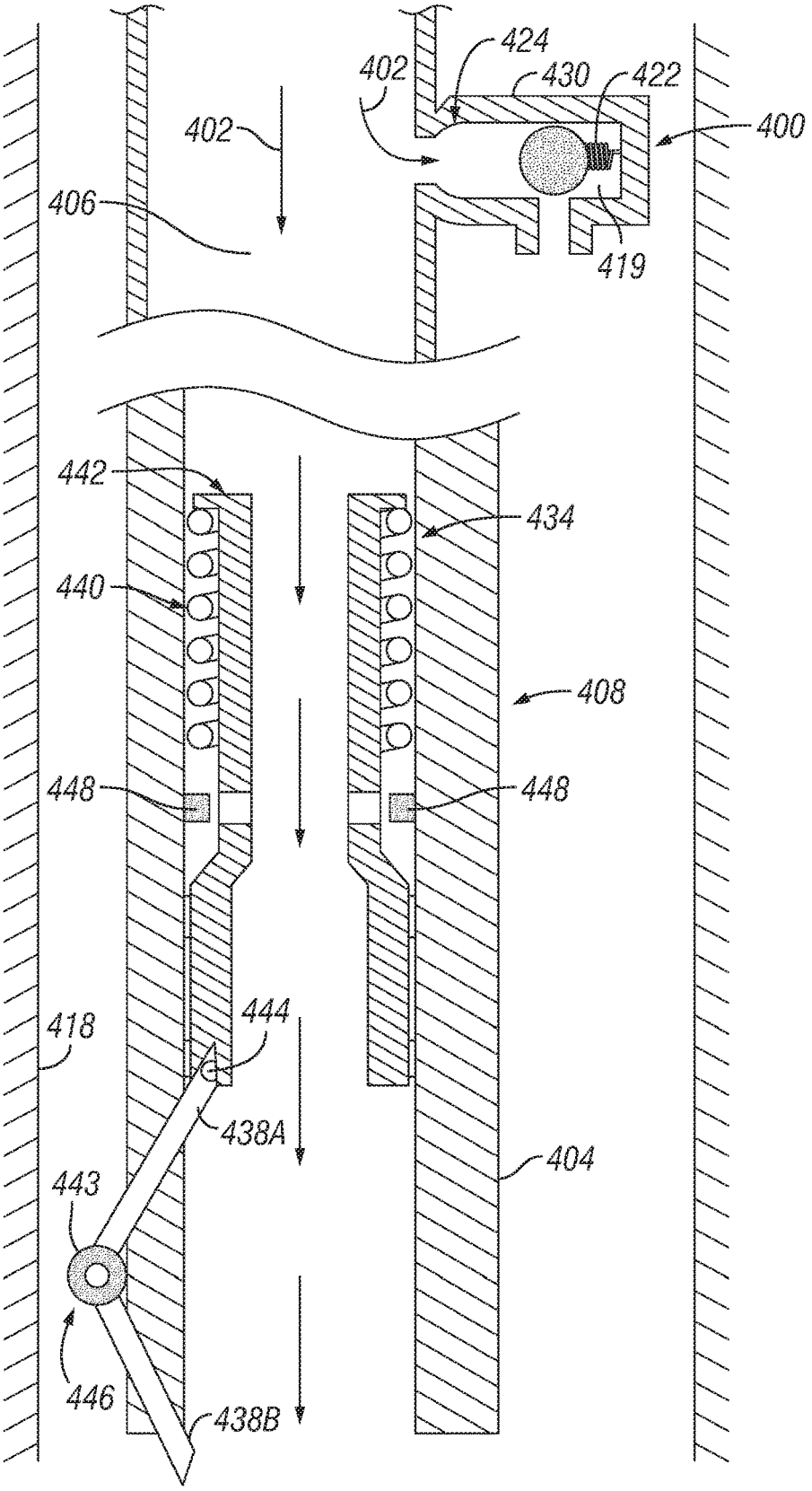
FIG. 4B is a cross-sectional view of the expandable downhole reamer used with the actuation system of FIG. 4A, according to one or more embodiments.

FIG. 4B is a cross-sectional view of the expandable downhole reamer 434 in a retracted position 446. An increase in the rotational speed of a drill string 408 generates a centrifugal force greater than a biasing force exerted by a resistance member 422 of a valve 430 attached to the drill string 408. The centrifugal force exerts a force to move a closing member 420 away from a valve seat 424 and into an open position. When in the open position, a portion of the fluid 402 flowing through the drill string 408 is diverted into a cavity 419 of the valve 430. The diversion of the fluid 402 may lessen the pressure force exerted by the fluid 402 so that the piston 442 is not forced against a hard stop 448. In this regard, reamer arms 438A, 438B of the reamer 434 are placed in the retracted position 446 to retract towards the body 404 and away from a surface, for example, an inner surface of a wellbore 418. When in the retracted position 446, the reamer 434 is capable of passing through the wellbore 418 without coming into direct contact with a surface of the wellbore.

According, the reamer 434 of FIGS. 4A and 4B can be actuated to the expanded portion 436 or retracted position 446 the while continuing to operate the drill string 408 at a specified rotational speed. The actuation system 400 may include the actuation systems 200, 300 as described with respect to FIGS. 2A, 2B, 3A, and 3B, or other types of actuatable systems and devices.

In addition to the embodiments described above, many examples of specific combinations are within the scope of the disclosure, some of which are detailed below:

Example 1

An actuation system to control flow of a fluid, comprising: a body comprising an axial cavity; a valve in fluid communication with the axial cavity, the valve comprising a closing member moveable into and out of a closed position against the valve seat, wherein fluid from the axial cavity can flow through and out of the valve when the closing member is out of the closed position, and a resistance member; wherein the closing member is biased into or out of the closed position by a force applied by the resistance member; and wherein the closing member is movable out of or into the closed position upon a rotational speed and fluid pressure within the axial cavity being sufficient to overcome the force applied by the resistance member.

Example 2

The actuation system of Example 1, wherein the position of the closing member moves to an open position or the closed position when the rotational speed of the body increases above a minimum threshold.

Example 3

The actuation system of Example 2, wherein the position of the closing member changes to the closed position or the open position when the rotational speed of the body decreases below the minimum threshold.

Example 4

The actuation system of Example 1, wherein the body comprises a drill string and the valve comprises a check valve.

Example 5

The actuation system of Example 1, wherein rotation of the body exerts a centrifugal force on the closing member.

Example 6

The actuation system of Example 1, wherein the resistance member comprises a spring.

Example 7

The actuation system of Example 1, further comprising a downhole tool attached to the actuation system, wherein the downhole tool is configured to retract or expand based on the position of the closing member Example 8

The actuation system of Example 1, wherein the valve may be actuated open or closed with the body rotating.

Example 9

A method of operating an actuation system of a downhole tool, comprising rotating a body comprising a central bore and a valve rotatable with the body at a rotational speed, adjusting the rotational speed of the body and the valve to change a position of a closing member of the valve between an open position and a closed position, and flowing fluid from inside the central bore through and outside the valve with the closing member out of the closed position.

Example 10

The method of Example 9, wherein adjusting the rotational speed comprises increasing the rotational speed of the body to change the position of the closing member to the open position or the closed position.

Example 11

The method of Example 9, wherein adjusting the rotational speed comprises decreasing the rotational speed of the body to change the position of the closing member to the closed position or the open position.

Example 12

The method of Example 9, further comprising preventing flow through the valve when the closing member is in the closed position.

Example 13

The method of Example 9, further comprising allowing flow through the valve when the closing member is out of the closed position.

Example 14

The method of Example 9, further comprising maintaining the closing member in an open position when the rotational speed of the body increases.

Example 15

The method of Example 9, further comprising maintaining the closing member in a closed position when the rotational speed of the body increases.

Example 16

The method of Example 9, further comprising continuing to rotate the body when the position of the valve member is changed to the closed position.

Example 17

The method of Example 9, further comprising changing the position of the valve to at least one of a partially open position or a partially closed position.

Example 18

The method of Example 9, wherein the downhole tool is a reamer and wherein the position of the valve moves the reamer into a retracted position or an expanded position.

Example 19

A method of controlling a flow of a fluid through a valve, comprising flowing a fluid into a central bore of a body, adjusting a rotational speed of the body to change a position of the valve and control the flow of the fluid between the central bore and the valve.

Example 20

The method of Example 18, comprising increasing or decreasing the rotational speed of the rotatable body to allow the flow of the fluid from the central bore through the valve.

Example 21

The method of Example 18, comprising decreasing or increasing the rotational speed of the rotatable body to prevent the flow of the fluid through the central bore into the valve.

While the invention has been shown and described with respect to certain preferred embodiments, it is obvious that equivalent alterations and modifications will occur to others skilled in the art upon the reading and understanding of the specification. In particular, the present disclosure is not limited to a specific placement or number of valves. For instance, additional valves may be strategically located in the well bore environment to achieve exemplary drilling and production performance. Further, the disclosure provided may not be limited to downhole operations, but the drill string may include any type of rotatable shaft used in a variety of environments.

The previous discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the previous description has broad application, and the discussion of any embodiment is meant only to be exemplary of that embodiment, and not intended to intimate that the scope of the disclosure, including the claims, is limited to that embodiment.

Certain terms are used throughout the previous description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the previous discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment. Further, the illustrated figures included within are only exemplary and are not intended to assert or imply any limitation with regard to the environment, architecture, design, or process in which different embodiments may be implemented.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An actuation system to control flow of a fluid, comprising:

a body comprising an axial cavity;

a valve in fluid communication with the axial cavity, the valve comprising a closing member moveable into and out of a closed position against a valve seat, wherein fluid from the axial cavity can flow through and out of the valve when the closing member is out of the closed position and a resistance member;

a downhole tool attached to the actuation system, wherein the downhole tool is configured to extend radially outward from the body based on the position of the closing member;

wherein the closing member is biased into or out of the closed position by a force applied by the resistance member;

wherein the closing member is movable out of or into the closed position upon a rotational speed and fluid pressure within the axial cavity being sufficient to overcome the force applied by the resistance member; and wherein rotation of the body exerts a centrifugal force on the closing member that moves the closing member either out of or into the closed position.

2. The actuation system of claim 1, wherein the position of the closing member moves to an open position or the closed position when the rotational speed of the body increases above a minimum threshold.

3. The actuation system of claim 2, wherein the position of the closing member changes to the closed position or the open position when the rotational speed of the body decreases below the minimum threshold.

4. The actuation system of claim 1, wherein the body comprises a drill string and the valve comprises a check valve.

5. The actuation system of claim 1, wherein the resistance member comprises a spring.

6. The actuation system of claim 1, wherein the valve may be actuated open or closed with the body rotating.

7. A method of operating an actuation system of a downhole tool, the method comprising:

rotating a body comprising a central bore and a valve rotatable with the body at a rotational speed;

adjusting the rotational speed of the body and the valve to exert a centrifugal force on a closing member of the valve to move the closing member between an open position and a closed position; and flowing fluid from inside the central bore through and outside the valve with the closing member out of the closed position to extend the downhole tool radially outward from the body.

8. The method of claim 7, wherein adjusting the rotational speed comprises increasing the rotational speed of the body to change the position of the closing member to the open position or the closed position.

9. The method of claim 7, wherein adjusting the rotational speed comprises decreasing the rotational speed of the body to change the position of the closing member to the closed position or the open position.

10. The method of claim 7, further comprising preventing flow through the valve when the closing member is in the closed position.

11. The method of claim 7, further comprising allowing flow through the valve when the closing member is out of the closed position.

12. The method of claim 7, further comprising maintaining the closing member in an open position when the rotational speed of the body increases.

13. The method of claim 7, further comprising maintaining the closing member in a closed position when the rotational speed of the body increases.

14. The method of claim 7, further comprising continuing to rotate the body when the position of the valve member is changed to the closed position.

15. The method of claim 7, further comprising changing the position of the valve to at least one of a partially open position or a partially closed position.

16. The method of claim 7, wherein the downhole tool is a reamer and wherein the position of the valve moves the reamer into a retracted position or an expanded position.

17. The method of claim 16, comprising increasing or decreasing the rotational speed of the rotatable body to allow the flow of the fluid from the central bore through the valve or to prevent the flow of the fluid through the central bore into the valve.

18. A method of controlling a flow of a fluid through a valve, the method comprising flowing a fluid into a central bore of a body;

adjusting a rotational speed of the body to exert a centrifugal force on a closing member of the valve to change a position of the closing member and control the flow of the fluid between the central bore and the valve; and flowing fluid from inside the central bore through and outside the valve with the closing member out of the closed position to extend a downhole tool radially outward from the body.

* * * * *